United States Patent [19]

Rothschild, III et al.

[11] 4,095,736

[45] Jun. 20, 1978

[54] BAG CLOSURE HAVING VALVE SLEEVE

[75] Inventors: Arthur Louis Rothschild, III; Robert Olin Baxter, both of Camden, Ark.

[73] Assignee: International Paper Company, New York, N.Y.

[21] Appl. No.: 735,052

[22] Filed: Oct. 22, 1976

[51] Int. Cl.[2] ..... B65D 31/14

[52] U.S. Cl. ..... 229/62.5

[58] Field of Search ..... 229/62.5; 150/9

[56] References Cited

U.S. PATENT DOCUMENTS

| | | | |
|---|---|---|---|
| Re. 23,230 | 5/1950 | Lee | 229/62.5 |
| 2,189,847 | 2/1940 | Verwys | 229/62.5 |
| 2,528,419 | 10/1950 | Burroughs | 229/62.5 |
| 2,651,451 | 9/1953 | Bennett | 229/62.5 |
| 3,065,899 | 11/1962 | Means et al. | 229/62.5 |
| 3,130,897 | 4/1964 | Poklukar et al. | 229/62.5 |
| 3,187,984 | 6/1965 | Hollis et al. | 229/62.5 |
| 3,261,267 | 7/1966 | Becker | 93/35 |
| 3,482,762 | 12/1969 | Jones | 229/62.5 |
| 3,648,922 | 3/1972 | Gebo | 229/62.5 |
| 3,894,682 | 7/1975 | Harmsen | 229/62.5 |

FOREIGN PATENT DOCUMENTS

| | | | |
|---|---|---|---|
| 981,789 | 1/1965 | United Kingdom | 229/62.5 |

*Primary Examiner*—Stephen P. Garbe
*Attorney, Agent, or Firm*—Ronald A. Schapira

[57] ABSTRACT

A bag having an end closure through which the bag is filled after sealing of the closure. A valve sleeve is provided in the end closure through which a filling tube may be inserted for filling the bag. After completion of the filling operation, the valve sleeve is tightly flattened within the closure, so that the material filling the bag does not leak through the sleeve. The valve sleeve includes a flexible tubing secured to a reinforcing strip. The reinforcing strip is secured to the end closure along substantially its entire length when the closure is sealed and prevents the flexible tubing from crimping, so that it may be tightly flattened. A slit is provided in the valve sleeve from its inner end to about its middle along an axis parallel to the axis of insertion of the filling tube into the sleeve. The means for securing the reinforcing strip to the end closure covers substantially the closure contacting face of the strip, except in the area of the slit.

4 Claims, 8 Drawing Figures

BAG CLOSURE HAVING VALVE SLEEVE

BACKGROUND OF THE INVENTION

This invention is concerned with the provision in the end closure of a bag of a valve sleeve comprising a length of flexible plastic tubing, such as polyethylene tubing, and a kraft reinforcing strip secured together, both forming a means for insertion of a filling tube into the end closure to fill the bag. Use of such tubing in a valve sleeve for a valved bag is desirable, because being limp, the tubing is readily adapted to be pressed flat to seal itself. However, use of the limp tubing per se presents problems in the manufacture of the bag, for the limp tubing is difficult to handle in high speed bag making machinery. Also, when such limp tubing is used in a valve sleeve, it offers little resistance to crimping within the closure when it is sealed, which may tend to bulge the sleeve open and prevent it from becoming tightly flattened, thereby allowing leakage through the sleeve and out of the closure.

Among the objects of this invention is the provision of a valve sleeve in a valved bag, which does not crimp or otherwise not become tightly sealed after filling of the bag through the valve sleeve.

SUMMARY OF THE INVENTION

A bag closure having an improved valve sleeve through which the bag may be filled is provided. The valve sleeve is positioned in the sealed closure for filling of the bag, after which the sleeve is tightly flattened when the bag is overturned to prevent leakage through the sleeve and from the closure. The sleeve includes a flexible tubing secured to a reinforcing strip. A slit is provided in the sleeve from its inner end to about its middle along an axis parallel to the axis of insertion of the filling tube. The sleeve is secured within the closure when it is sealed. A closure contacting surface of the reinforcing strip is secured to the closure, except in the area of the slit. Preferably, an adhesive on the closure contacts the reinforcing strip, except in the area of the slit.

DESCRIPTION OF THE PREFERRED EMBODIMENTS

Figure 3:
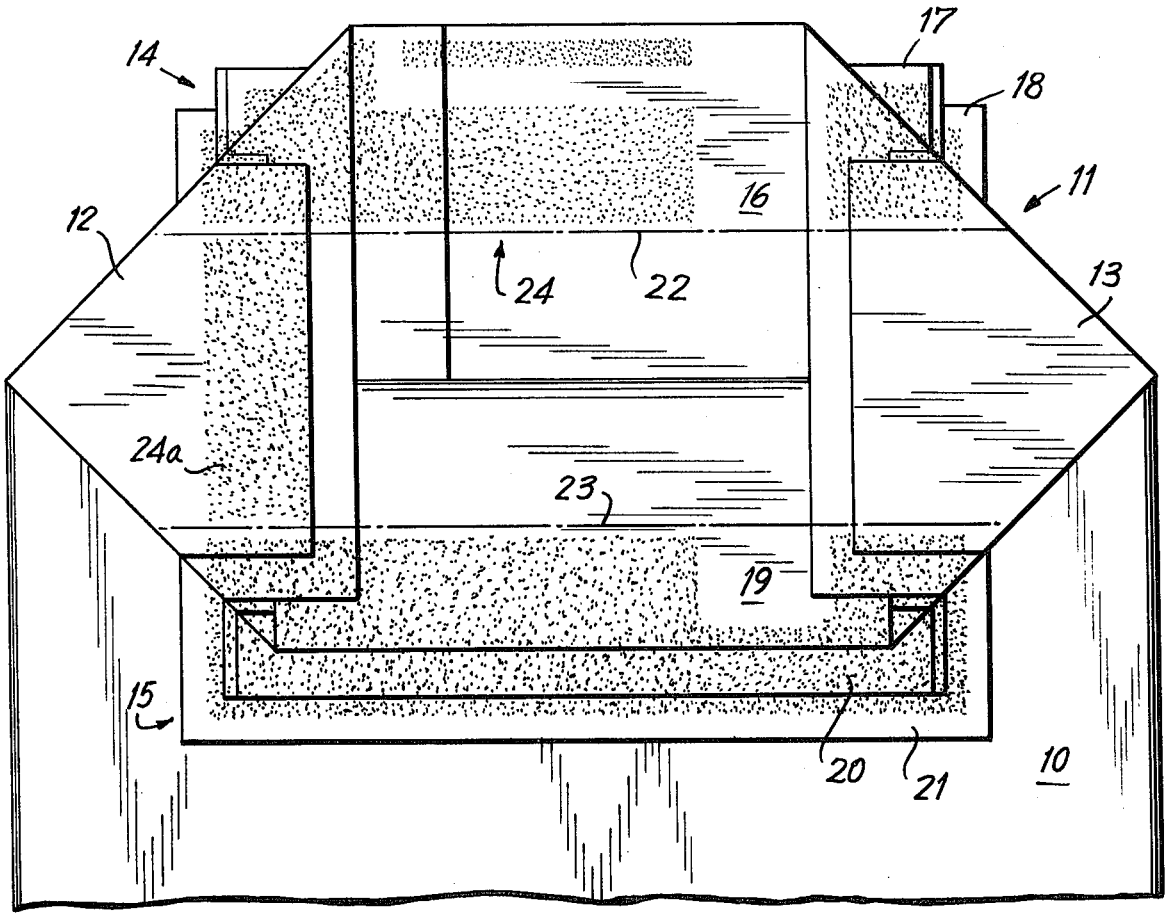
FIG. 3 is a view showing one end closure of the present invention in its opened-up conformation prior to the application of the valve sleeve of FIG. 2.

Referring to the drawings, there is indicated generally at 10 in FIG. 3 a flat paper bag tube provided with an end closure 11. Usually this will be a multi-wall paper bag. For convenience, there is illustrated in FIG. 3 only that end of the bag tube where the closure 11, which will be sealed, is to include a valve sleeve. Closure 11 is formed by opening up the end of the tube to form first and second inwardly directed end flaps 12 and 13. First and second side flaps are generally indicated at 14 and 15. Side flap 14 in this embodiment of the valved bag of the present invention includes an innermost flap 16, a second outer flap 17, and a third outermost flap 18. Similarly, side flap 15 includes an innermost flap 19, an outer flap 20, and an outermost flap 21. The apparently different dimensions of the component flaps of side flaps 14 and 15 contribute to the effective closing and sealing of the closure. As will be understood, the first side flap 14 is to be folded over upon a fold line 22 extending transversely of the tube, and the second side flap 15 is ultimately to be folded over on a fold line 23 extending transversely of the tubing to overlie first side flap 14. A pattern of adhesive, which is shown in FIG. 3 and indicated generally at 24, provides the means for sealing the flaps to the end closure, to themselves for closing the end of the bag, and to the valve sleeve described below.

Figure 1:
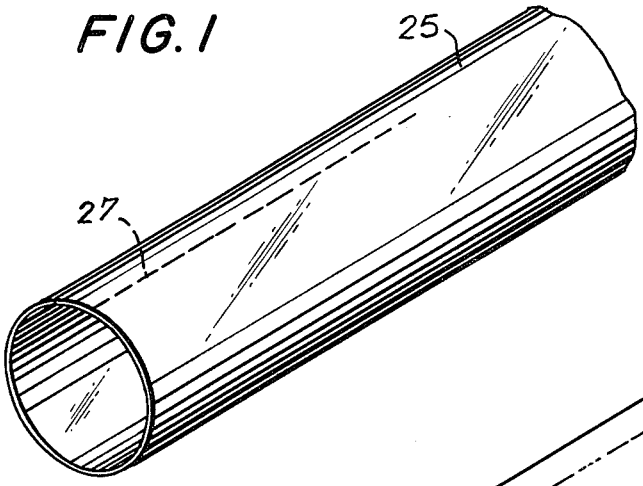
FIG. 1 is a perspective view, partially cut away, of the flexible tubing of the valve sleeve of the bag end closure of the present invention.
Figure 2:
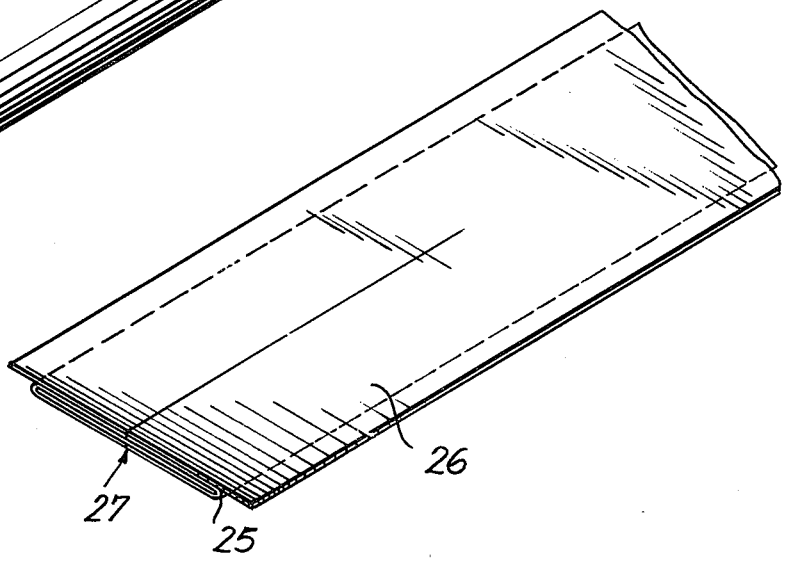
FIG. 2 is a perspective view, partially cut away, of the valve sleeve of the bag end closure of the present invention.

FIG. 2 shows a valve sleeve S to be applied to the end closure 11 of FIG. 3. The sleeve is generally flat when not in use, and includes a flexible tubing 25 and a kraft reinforcing strip 26. The tubing 25 is shown in its expanded conformation in FIG. 1, which conformation it would have when a filling tube is inserted through it for filling the bag. Preferably, the edges of strip 26 are folded over upon the face of the strip to which tubing 25 is not secured, as shown by dotted line in FIG. 2. Particularly important in this valve sleeve is a slit 27. The slit extends from one end of the sleeve to about its middle along an axis parallel to the axis of insertion of the filling tube, which slit is shown in dotted line in FIG. 1 for ease of understanding.

Figure 4:
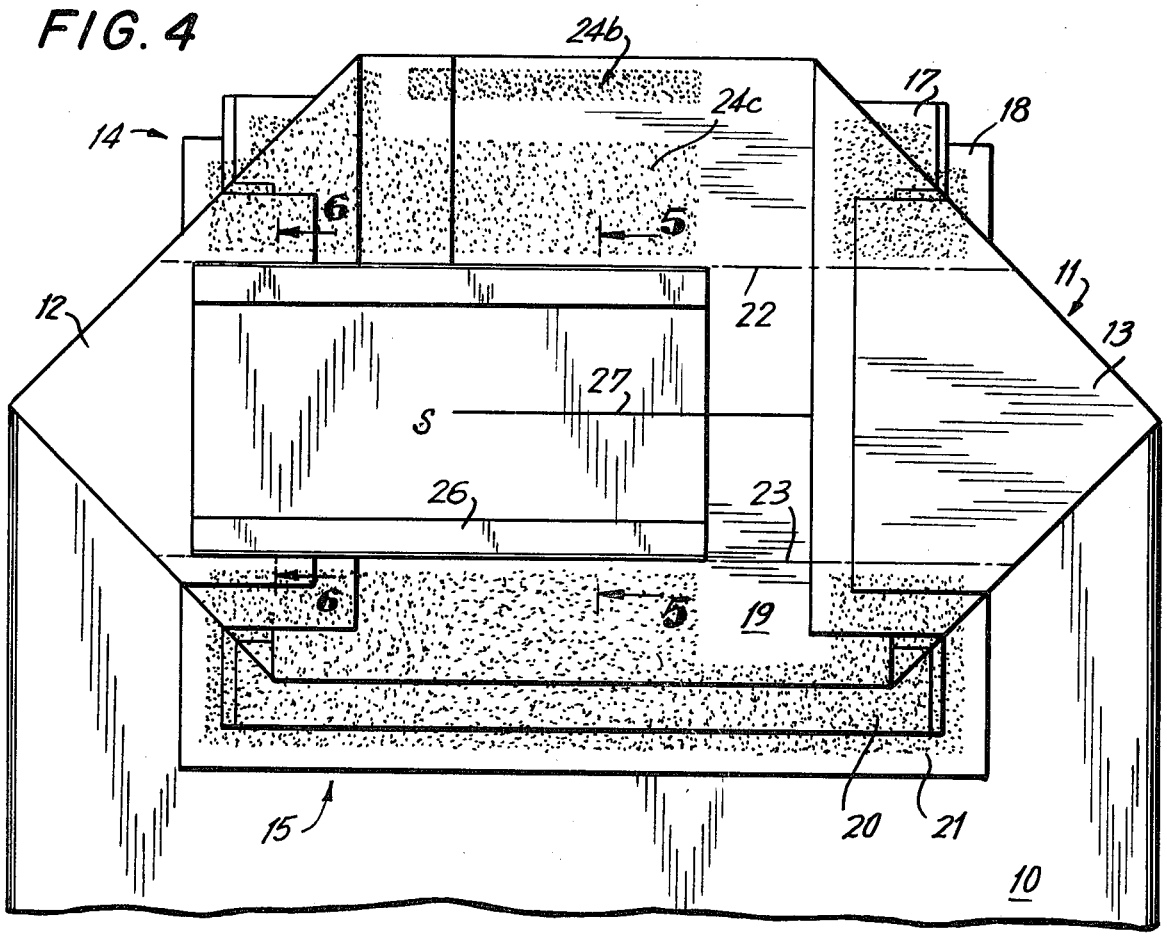
FIG. 4 is a view similar to FIG. 3 showing the valve sleeve applied to the opened-up end closure.
Figure 5:
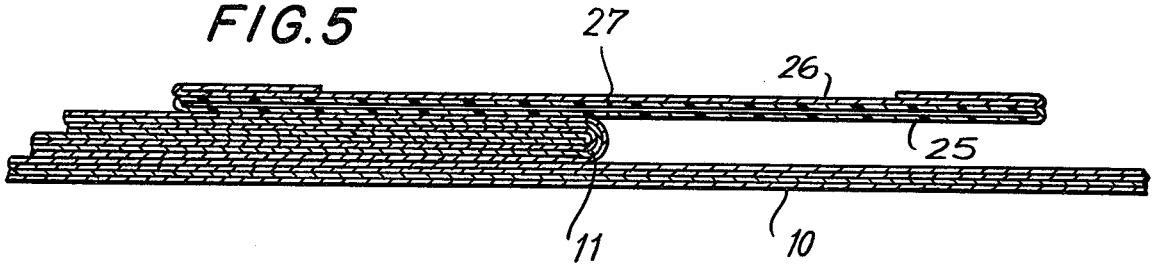
FIG. 5 is a cross sectional view taken along lines 5—5 of FIG. 4.
Figure 6:
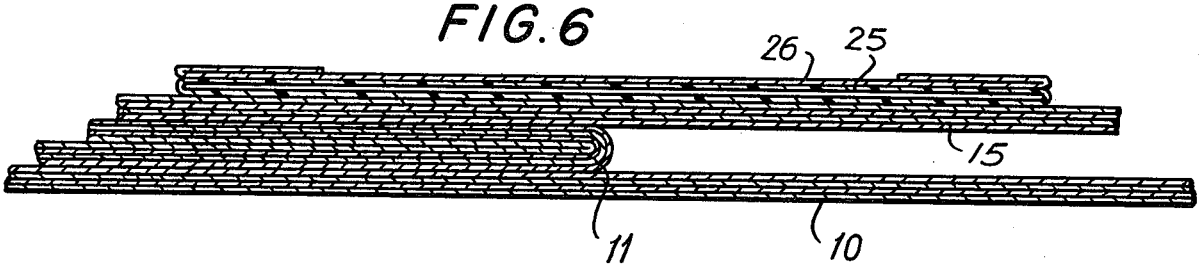
FIG. 6 is a cross sectional view taken along lines 6—6 of FIG. 4.

Sleeve S is applied to closure 11 prior to the closure being sealed, as shown in FIG. 4. Referring back to FIG. 3, a portion of adhesive **24*a* covers closure 11. Essentially sleeve S is placed on closure 11 and secured by adhesive 24*a* to the closure. Thus, one face of tubing 25 is secured to strip 26, as shown in FIG. 2, and the other face of tubing 25 is secured to closure 11, as shown in FIG. 4**.

Figure 7:
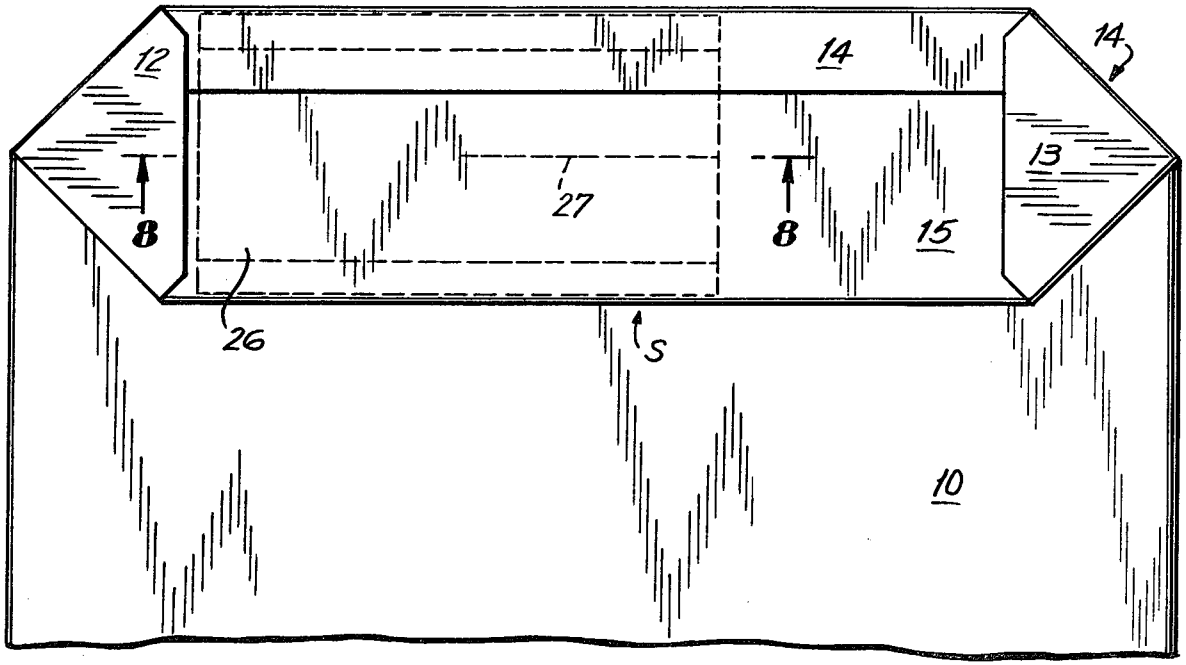
FIG. 7 is a view showing the end closure sealed, wherein the valve sleeve applied thereto is shown in dotted line.

To seal closure 11, flap 14 is folded over fold line 22 onto sleeve S and flap 15 is folded over fold line 23 onto flap 14. Sealed end closure 11 is shown in FIG. 7. Referring again to FIG. 4, it is apparent that the portions of adhesive **24*b* and *c* on flap 14 of closure 11 will contact the other face of reinforcing strip 26, except in the area of slit 27**. This provides advantages over and eliminates disadvantages of prior art valved bags.

For instance, to seal closure 11 and prevent leakage through the sleeve, the sleeve must be tightly flattened. This is best accomplished by preventing crimping of flexible tubing 25. Securing of strip 26 substantially along its entire length to closure 11 helps prevent this crimping. However, it has been found that the adhesive utilized to secure strip 26 to closure 11 may interfere with the flattening of tubing 25, if there is adhesive in the area of slit 27. To avoid this problem, the adhesive pattern 24 does not include adhesive in the area of slit 27. It is apparent that the area of flap 14 which will overlie slit 27 when the closure is sealed is not covered with adhesive, as are the surrounding areas.

Figure 8:
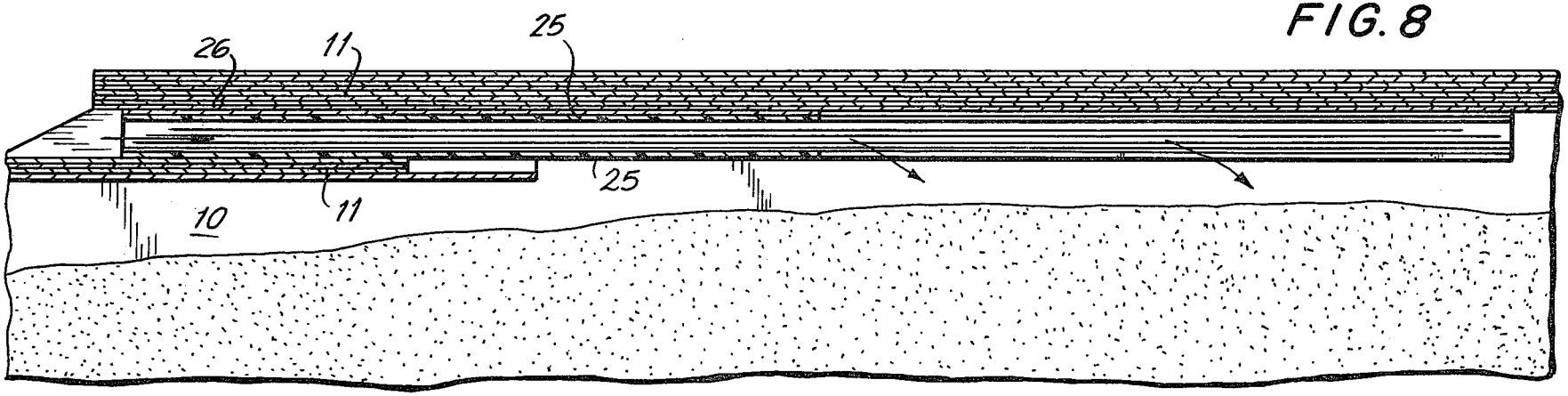
FIG. 8 is a cross sectional view taken along lines 8—8 of FIG. 7.

Referring to FIG. 8, this latter advantage of omitting adhesive in the area of slit 27 is more readily understood. Once closure 11 is sealed, material may be put into the bag through a filling tube inserted in sleeve S. After the filling operation is completed, generally the bag is overturned so that the weight of the material compresses the valve sleeve and prevents leakage therethrough and out of the closure. However, if adhesive is utilized in the area of slit 27, particles of the material may stick to the adhesive and prevent the tight flattening of the valve sleeve. Thus, in one way, the bag closure of the present invention eliminates crimping of the flexible tubing by the utilization of a reinforcing strip secured to the closure along substantially its entire length and, in another way, by the omission of adhesive in the area of the slit in the valve sleeve that may prevent the complete sealing of the valve sleeve and end closure. Thus, a valve sleeve longer than those commonly known may be utilized, the probability of the sleeve being accidentally closed by adhesive is eliminated, and the probability of particles of the material filling the bag sticking to any adhesive in the area of the slit is eliminated.

Other embodiments of this invention will occur to those skilled in the art in view of this disclosure.

What is claimed is:

1. A bag having an end closure, through which it is filled, the end closure comprising a valve sleeve and the valve sleeve comprising a flexible tubing secured to one face of a reinforcing strip; the other face of the strip being secured along substantially its entire length to the closure; the sleeve, including its flexible tubing and its reinforcing strip, being slit, from top to bottom, from its inner end to about its middle along an axis parallel to an axis of insertion of a filling tube through the sleeve to fill the bag; and the strip being free from securement with the closure in the area of the slit.

2. The bag of claim 1 wherein one face of the tubing is secured to the reinforcing strip and the other face of the tubing is secured to the closure.

3. The bag of claim 1 wherein the strip and tubing are secured to each other and to the closure by an adhesive.

4. The bag of claim 3 wherein the adhesive securing the strip to the closure contacts the strip except in the area of the slit.

* * * * *

UNITED STATES PATENT AND TRADEMARK OFFICE

CERTIFICATE OF CORRECTION

PATENT NO. : 4,095,736

DATED : June 20, 1978

INVENTOR(S) : Rothschild et al

It is certified that error appears in the above-identified patent and that said Letters Patent are hereby corrected as shown below:

In the Drawings, Figure 1 should be --

FIG. 1

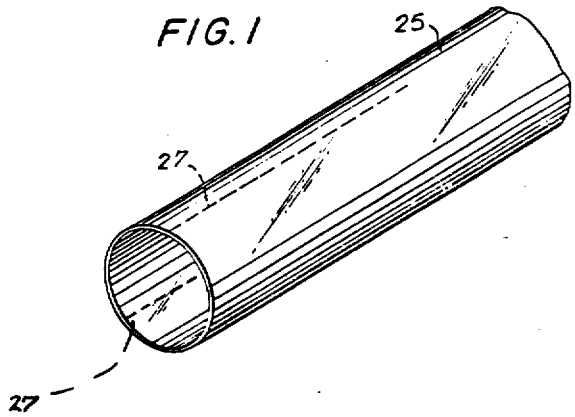

-- .

Signed and Sealed this

Twentieth Day of March 1979

[SEAL]

Attest:

RUTH C. MASON
Attesting Officer

DONALD W. BANNER
Commissioner of Patents and Trademarks